US007281417B2

(12) United States Patent
Saegusa et al.

(10) Patent No.: US 7,281,417 B2
(45) Date of Patent: Oct. 16, 2007

(54) METHOD FOR EVALUATING QUALITY OF GOLF CLUB HEAD, METHOD FOR CONDUCTING QUALITY CONTROL OF GOLF CLUB HEAD, METHOD FOR MANUFACTURING GOLF CLUB HEAD AND GOLF CLUB, GOLF CLUB HEAD, AND GOLF CLUB

(75) Inventors: Hiroshi Saegusa, Kanagawa Prefecture (JP); Kazunori Ono, Kanagawa Prefecture (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 784 days.

(21) Appl. No.: 10/411,234

(22) Filed: Apr. 10, 2003

(65) Prior Publication Data

US 2004/0101812 A1 May 27, 2004

(30) Foreign Application Priority Data

Apr. 11, 2002 (JP) ..... 2002-109326
Apr. 16, 2002 (JP) ..... 2002-113073

(51) Int. Cl.
*A63C 53/00* (2006.01)
*A63B 53/00* (2006.01)

(52) U.S. Cl. ..... 73/65.03

(58) Field of Classification Search ..... 73/65.03
See application file for complete search history.

(56) References Cited

U.S. PATENT DOCUMENTS 4,399,514 A 8/1983 Hamasaki et al.
4,928,965 A * 5/1990 Yamaguchi et al. ..... 473/332
5,703,294 A * 12/1997 McConnell et al. ..... 73/579
6,348,016 B2 * 2/2002 Nakamura ..... 473/371
6,431,996 B1 * 8/2002 Wright et al. ..... 473/318
6,585,605 B2 * 7/2003 Erickson et al. ..... 473/282
6,595,057 B2 * 7/2003 Bissonnette et al. ..... 73/579
6,605,007 B1 * 8/2003 Bissonnette et al. ..... 473/329

(Continued)

FOREIGN PATENT DOCUMENTS

JP 51-098068 A 8/1976

(Continued)

OTHER PUBLICATIONS

Japanese Decision of Refusal dated Sep. 12, 2006 in Japanese Patent Application No. 2002-113073.

*Primary Examiner*—Max Noori
(74) *Attorney, Agent, or Firm*—Finnegan, Henderson, Farabow, Garrett & Dunner, L.L.P.

(57) ABSTRACT

Evaluation of the durability or the coefficient of restitution of a golf club head 1 is performed by measuring a response signal of an impact surface 10 of a golf club head 1 when imparting a vibration to the impact surface 10, finding a value of the peak frequency of the first resonance frequency or the like located within a predetermined frequency range of the measured response signal, and finding the ratio of this peak frequency value with respect to a reference value. Further, control of the quality of the restitution characteristics in a initial state, or quality of the golf club head that deteriorates over time, is conducted by utilizing the evaluation results. The golf club head 1 is provided with a label 12 for displaying the peak frequency measured immediately after manufacture as an initial value. Further, in manufacturing a golf club, the quality of the golf club head immediately after manufacture is controlled by the peak frequency.

6 Claims, 5 Drawing Sheets

U.S. PATENT DOCUMENTS

| | | | | |
|---|---|---|---|---|
| 6,960,142 | B2 * | 11/2005 | Bissonnette et al. | 473/329 |
| 6,997,035 | B2 * | 2/2006 | Saegusa et al. | 73/11.01 |
| 7,162,913 | B2 * | 1/2007 | Saegusa et al. | 73/11.01 |
| 2001/0006913 | A1 * | 7/2001 | Shiraishi et al. | 473/324 |
| 2003/0004007 | A1 * | 1/2003 | Erickson et al. | 473/221 |
| 2004/0005938 | A1 * | 1/2004 | Saegusa et al. | 473/409 |
| 2005/0004779 | A1 * | 1/2005 | Ueda et al. | 702/182 |

FOREIGN PATENT DOCUMENTS

| | | | | |
|---|---|---|---|---|
| JP | 60-256052 | A | | 12/1985 |
| JP | 61-23966 | | | 2/1986 |
| JP | 5-33071 | | | 5/1993 |
| JP | 2000-131296 | | | 5/2000 |
| JP | 2000131296 | A | * | 5/2000 |
| JP | 2000-300700 | | | 10/2000 |
| JP | 2000300700 | A | * | 10/2000 |
| JP | 2002331050 | A | * | 11/2002 |

* cited by examiner

METHOD FOR EVALUATING QUALITY OF GOLF CLUB HEAD, METHOD FOR CONDUCTING QUALITY CONTROL OF GOLF CLUB HEAD, METHOD FOR MANUFACTURING GOLF CLUB HEAD AND GOLF CLUB, GOLF CLUB HEAD, AND GOLF CLUB

FIELD OF THE INVENTION

The present invention relates to a method for evaluating the quality of a golf club head having a hollow structure and made of a metal, an alloy, or the like, a method for conducting quality control of a golf club, a method for manufacturing a golf club head, a golf club head, a method for manufacturing a golf club, and a golf club. In particular, the present invention relates to: a method for evaluating the quality of a golf club in which the deterioration of golf club durability accompanying the number of impacts is evaluated; a method for conducting quality control of a golf club head in which structural defects of a golf club head, its coefficient of restitution, its durability, and the like, which are difficult to control through only visual inspection, are controlled; a method for manufacturing a golf club head; a golf club head; a method for manufacturing a golf club; and a golf club.

DISCLOSURE OF THE PRIOR ART

Recently, various types of golf club heads having good restitution and being capable of driving golf balls a very long distance with a golf club have been proposed.

For example, the coefficient of restitution of an impact surface of a golf club head is increased by using a special material, such as a titanium alloy or the like, for the impact surface which hits a golf ball, and by reducing the thickness of the member including the impact surface. In addition, along with the reduction in the thickness of the impact surface of the golf club head, limit design for reducing thickness of portions joined to the impact surface is being performed.

A golf club provided with this type of golf club head drives a golf ball particularly far to attain carry, which leads to a better score, and therefore is a valuable tool for golf competitors.

Golf club heads which thus attain carry of a golf ball tend to have the thickness of the member including the impact surface reduced as discussed above, and therefore strict control of quality such as golf club head durability, impact performance, or the like becomes very important in order to avoid unpredictable sudden breakage of the entire golf club head when hitting a golf ball.

By the way, evaluation of durability regarding breakage of a golf club head is generally performed by imparting an impact directed to the impact surface of the golf club head by using an air cannon, by repeatedly imparting impacts to the impact surface of the golf club head by hitting golf balls using a testing robot or a golfer, or the like, and then visually verifying cracks in the golf club head or the level of damage thereof after a predetermined number of impacts is employed.

However, with a conventional golf club head durability evaluation, cracks in the golf club head or the level of damage thereof is verified visually, and therefore a state of breakage can only be verified by large cracks or damage developing in the surface. A golf club head that has breakage verified visually is in a state in which the possibility of sudden, breakage of its entirety due to hitting of a golf ball is extremely high. That is, a golf club head, damage of which can verified visually, has already exceeded its lifetime. There is a problem with this conventional durability evaluation, which can verify only visually the golf club head, in that rigorous evaluation of golf club head durability cannot be performed.

In addition, breakage processes such as crack development, crack growth, and the like cannot be investigated with conventional quality evaluation. Thus, this is being a large impediment to the development of golf club heads subject to the limit design to increase the coefficient of restitution while maintaining durability.

Further, for golf club heads that have undergone the limit design to reduce the thickness of the impact surfaces, it is necessary to quantitatively predict the lifetime of the current golf club head in use.

On the other hand, the restitution characteristic of the impact surface of the golf club head is becoming very important for the golf club impact performance. As is well known, United States Golf Association (hereinafter referred to as USGA) has instituted a regulation on golf clubs that drive golf balls too far, due to excellent restitution characteristic, for professional golf competitions. The regulation stipulates that golf clubs having a coefficient of restitution e, found by a method discussed below, equal to or less than 0.830 are to be used in golf competitions.

FIG. 9 is a schematic diagram showing a method for measuring the coefficient of restitution of a golf club head. As shown in FIG. 9, the coefficient of restitution e between a golf ball 40 and a golf club head 1 is measured by making the golf ball 40 impact perpendicularly against an impact surface 10 of the golf club head 1 in a state in which the golf club head 1 is placed on an installation stand (not shown). The coefficient of restitution e is a value found from the relationship equation (equation shown below) between an incident velocity $V_{in}$ of the golf ball 40, a rebound velocity $V_{out}$, a mass M of the golf club head 1, and a mass m of the golf ball 40 at this time.

$$V_{out}/V_{in}=(e\cdot M-m)/(M+m)$$

The coefficient of restitution thus defined is also subject to regulation by the USGA, and is one of very important quality control items for golf clubs.

On the other hand, although quality such as the coefficient of restitution or durability of golf club heads is evaluated and controlled at the design stage and prototype stage, in practice, it is not controlled at the mass production stage and produced product stage. Further, the durability or the coefficient of restitution of a golf club head cannot be judged from visual inspection during golf club manufacture. It is not possible at present to accurately distinguish between finished products having quality characteristics within a permissible range (acceptable products) and unacceptable products. Therefore, there is a problem for the mass production of golf clubs in that it is not possible to distinguish whether or not mass produced golf club heads satisfy durability characteristics and whether or not their coefficient of restitution is satisfactory. Further, a method for evaluating golf club head durability has not yet been established. Thus, there is a problem in that a follow-up investigation into whether or not golf club heads have sufficient durability after a lapse of a predetermined period of time during which the golf clubs are used, cannot be performed.

OBJECTS AND SUMMARY OF THE INVENTION

The present invention has been made in view of solving these problems, and therefore it is an object of the present invention is to provide: a method for evaluating the quality of a golf club head in which it is possible to non-destructively evaluate the development of breakage in the golf club head, such as cracks, damage, and the like, as well as the quality such as durability or the like by grasping the existence of crack development or damage in the golf club head before a point at which the cracks or damage can be verified visually; a method for conducting quality control of a golf club head in which the quality that can not be controlled by visual inspection, such as golf club head durability, golf club durability, coefficient of restitution, or the like can be controlled; a method for manufacturing a golf club head; a golf club head; a method for manufacturing a golf club; and a golf club.

The present invention provides a method for evaluating the quality of a golf club head in which the quality of the golf club head is evaluated after a plurality of impacts are imparted to an impact surface of the golf club head, and is characterized by including the steps of: measuring a response signal of the impact surface of the golf club head when a vibration is imparted to the impact surface; and evaluating the quality of the golf club head by finding a peak frequency value positioned within a predetermined frequency range of the measured response signal, and by using a ratio of the peak frequency value with respect to a reference value.

In this case, the quality is, for example, the durability of the golf club head. Further, the reference value may be a peak frequency value of the response signal of the impact surface obtained when a vibration is imparted to the impact surface when the golf club head is in an initial state, the peak frequency positioned within the predetermined frequency range. The term golf club head in an initial state as used in this specification refers to a golf club head in which the cumulative number of times of impacts imparted to the impact surface thereof from the time of its manufacture by a golf ball or by impacts equivalent thereof is equal to or less than 10.

In the present invention, the peak frequency obtained in the evaluation step and the peak frequency taken as the reference value can both be resonance frequencies of the impact surface of the golf club head. Further, both of the resonance frequencies may be first resonance frequencies located in a frequency range from 2000 Hz to 7000 Hz.

Further, in the present invention, defects may be judged as having developed in the golf club head for cases in which the ratio of the peak frequency value to the reference value is less than 95% in the evaluation process.

Further, it is preferable that the response signal be a sound pressure signal of a sound of the impact which generates when imparting a vibration to the impact surface.

Further, the present invention provides a method for conducting quality control of a golf club head, including the steps of: measuring a peak frequency of vibration of an impact surface of the golf club head in an initial state from a response signal obtained by imparting a vibration to the impact surface; and selecting the golf club head as an acceptable product if the peak frequency in the initial state is within a predetermined range to conduct the quality control using the peak frequency.

According to the present invention, the above-mentioned method further includes the step of recording and storing the peak frequencies of the golf club head selected as an acceptable product, making it correspond to information for distinguishing the golf club head after the selecting step. The peak frequency specified by the distinguishing information can be set to an initial value to be used for investigating changes in quality of the golf club head over time. In this case the changes in quality of the golf club head over time may be changes with respect to the initial value of the peak frequency. Further, the peak frequency is, for example, a first resonance frequency of the impact surface.

In addition, the present invention provides a method for manufacturing a golf club head, including the steps of: forming the golf club head; measuring the peak frequency of a vibration of an impact surface of the manufactured golf club head from a response signal obtained by imparting a vibration to the impact surface; and selecting the golf club head as an acceptable product for cases in which the measured peak frequency is within a predetermined range, to manufacture with the quality thereof controlled by using the peak frequency of the golf club head.

In this case, it is preferable that the above-mentioned method further includes a step of recording the peak frequency, making it correspond to information for distinguishing the golf club head selected as an acceptable product after the selecting step.

Further, the present invention provides a golf club head in which an initial product quality thereof is controlled by a peak frequency of a vibration of an impact surface of the golf club head in an initial state, and which includes a displaying means that displays the peak frequency.

In the present invention, the peak frequency is, for example, a measurement result obtained from a response signal which generates when imparting a vibration to the impact surface of the golf club head in the initial state.

In addition, the present invention provides a method for manufacturing a golf club which includes the steps of: measuring a peak frequency of a vibration of an impact surface of the golf club head in an initial state from a response signal obtained by imparting vibration to the impact surface; selecting the golf club head as an acceptable product for cases in which the peak frequency is positioned within a predetermined permissible range; and assembling a golf club shaft into the acceptable golf club head.

According to the present invention, the above-mentioned method further includes the step of recording and storing the peak frequency of the golf club head selected as an acceptable product, making it correspond to information for distinguishing the golf club head, as a step after the selecting step. The peak frequency specified by the distinguishing information can be set, for example, as an initial value to be used for investigating changes in the quality of the golf club head over time. In this case it is preferable that the changes in the quality of the golf club head over time be changes with respect to the initial value of the peak frequency. Further, the peak frequency is, for example, a first resonance frequency of the impact surface.

Further, the present invention provides a method for manufacturing a golf club, which includes the steps of: assembling a golf club shaft into a golf club head in an initial state; measuring a peak frequency of a vibration of an impact surface of the golf club head, to which the golf club shaft is assembled, from a response signal obtained by imparting a vibration to the impact surface; and selecting the golf club head as an acceptable product for cases in which the peak frequency is positioned within a predetermined permissible range.

According to the present invention, the above-mentioned method further includes the step of recording and storing the peak frequency of the golf club head selected as an acceptable product, making it correspond to information for distinguishing the golf club head after the selecting step. The peak frequency specified by the distinguishing information can be set as an initial value to be used for investigating changes in the quality of the golf club head over time. In this case, it is preferable that the changes in the quality of the golf club head over time be changes with respect to the initial value of the peak frequency. Further, the peak frequency is, for example, a first resonance frequency of the impact surface.

In addition, the present invention provides a golf club which includes: a golf club head whose initial quality is controlled by a peak frequency of a vibration of an impact surface of the golf club head in an initial state; a golf club shaft assembled into the golf club head; and a displaying means that displays the peak frequency.

In the present invention, it is preferable that the peak frequency be a measurement result obtained from a response signal which generates when a vibration is imparted to the impact surface of the golf club head in the initial state.

DETAILED DESCRIPTION OF THE PREFERRED EMBODIMENTS

Hereinbelow, a method for evaluating the quality of a golf club head, a method for conducting quality control of a golf club head, a method for manufacturing a golf club head, a golf club head, a method for manufacturing a golf club, and a golf club, according to the present invention, are explained in detail based on preferred embodiments shown in the attached drawings.

Figure 1:
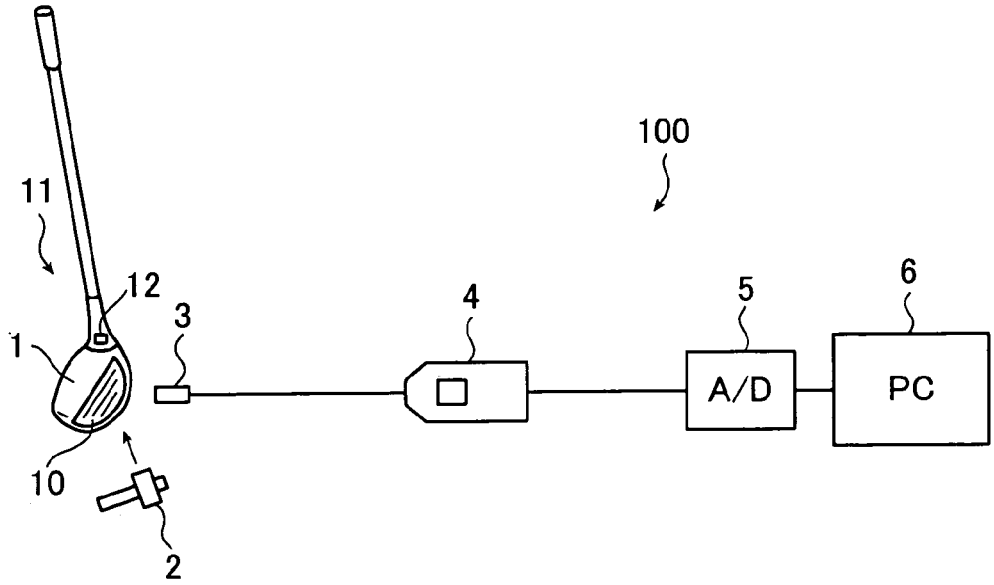
FIG. 1 is a schematic diagram showing a measuring device used in a method for evaluating the quality of a golf club head according to an embodiment of the present invention.

FIG. 1 is a schematic diagram showing a measuring device for measuring resonance frequencies, which is used in a method for evaluating the quality of a golf club head, and a method for conducting quality control of a golf club head, according to an embodiment of the present invention. Both the method for evaluating the quality of a golf club head and the method for conducting quality control of a golf club head of the present invention are characterized in that evaluation and control of quality such as coefficient of restitution or durability are performed by using measurement results obtained by measuring resonance frequencies of an impact surface of a golf club head.

As shown in FIG. 1, a microphone 3 is disposed in a face-to-face position to an impact surface 10 of a golf club head 1 in a measuring device 100, and a sound level meter 4 is connected to the microphone 3. The sound level meter 4 is connected to a personal computer 6 (hereinafter referred to as a PC) through an A/D converter 5.

The A/D converter 5 is a device for converting sound pressure signals output from the sound level meter 4 into digital signals, and sending them to the PC 6. The PC 6 is an analysis device for analyzing the frequency of the digitized sound pressure signals, and finding the first resonance frequency of the impact surface 10 of the golf club head 1. The first resonance frequency is found by a known frequency analysis algorithm in the PC 6. That is, a certain response signal, which is a sound pressure signal generated when a vibration is imparted to the impact surface 10, is measured and the first resonance frequency is found from the response signal.

A method for measuring the first resonance frequency is explained next.

A golf club 11 which is currently in use, and in a state in which the number of times of impacts thereto is unknown, is prepared. This golf club can be distinguished by at least by its brand name, product model, or type, such as golf club number, driver, spoon, or the like.

A hozel portion of the golf club head 1 of the golf club 11 is suspended in the vicinity of the microphone 3, or the golf club 11 is disposed in a state of being lightly supported.

Thereafter, a vibration is imparted to the impact surface 10 of the golf club head 1 by a hammer 2, causing the impact surface 10 to vibrate, and the impact sound generated upon imparting of the vibration is measured by the sound level meter 4 through the microphone 3. The impact sound measured by the sound level meter 4 is input to the PC 6 through the A/D converter 5, and the first resonance frequency is found by using a known method, for example, FFT (Fast Fourier Transformation) or the like.

Frequency analysis of a base band, for example, in a band from 0 Hz to 7000 Hz is performed by the PC 6 when finding the first resonance frequency. A plurality of peaks are developed in a band from 2000 Hz to 7000 Hz, but a development band of the first resonance frequency is set in advance according to the brand of the golf club 11, product model, or type, such as golf club number, driver, spoon, or the like. For example, the development band is set from 3200 to 5200 Hz, and the first resonance frequency is specified from a frequency waveform of the sound pressure signal.

On the other hand, the PC 6 calls up a reference value from a reference table that refers to the brand name, product model, or type, such as golf club number, driver, spoon, or the like, for distinguishing the golf club 11. This reference value is discussed later.

The PC 6 finds a ratio of the first resonance frequency to the reference value by using the reference value called up and the value of the specified first resonance frequency. For cases in which this ratio is less than 95%, an evaluation is made that the golf club head 1 after being given the impact is at least in a state in which defects such as damage, cracks, or the like have developed.

The reference value used here is the value of the first resonance frequency measured by performing the same measurements using the aforementioned measuring device on a golf club having a brand new golf club head to which impacts have not been imparted to the impact surface of the golf club head after manufacture, or having a golf club head to which the cumulative number of times of impacts due to hitting of a golf ball, or impacts corresponding thereto, is equal to or less than 10 times. That is, it is the value of each intrinsic first resonance frequency in the initial state of the golf club head.

The reference value can be specified by providing a reference table that possesses these kinds of reference values divided into brand, product model, or type, such as golf club number, driver, spoon, or the like, and by referring to the reference table, without being limited to those in which the first resonance frequency of the impact surface of the golf club head is measured in an initial state. Note that the first resonance frequency of the golf club head may also be measured at any time after a lapse of a predetermined period of time, and a follow-up investigation may be performed.

The durability of a golf club head can thus be evaluated because the inventors of the present invention have found the following knowledge.

Figure 2:
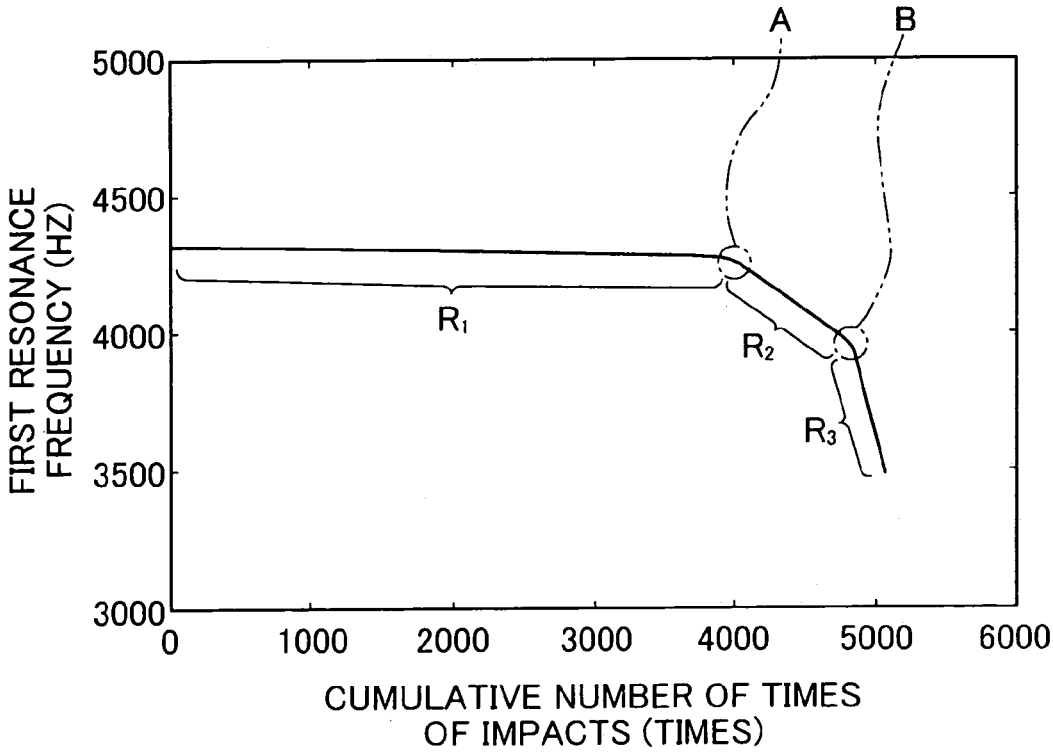
FIG. 2 is a graph schematically showing a state in which a first resonance frequency changes along with the number of times of impacts.

FIG. 2 is a graph that schematically shows a process of change in the first resonance frequency accompanied by the number of times of impacts, with the number of times of impacts on the horizontal axis and the first resonance frequency on the vertical axis.

Note that the example of FIG. 2 is performed under the testing conditions in which the thickness of the impact surface 10, which is manufactured from a titanium alloy, is 2.4 mm, and an impact force corresponding to a force generated by head speed of 40 m/sec is imparted.

As shown in FIG. 2, the inventors of the present invention discovered that a region $R_1$, in which the frequency of the first resonance frequency drops slightly accompanied by an increase in the cumulative number of times of impacts, a region $R_2$, in which the drop of the first resonance frequency accompanied by impacts becomes larger, and a region $R_3$, in which the drop in the first resonance frequency becomes increasingly larger accompanied by impacts, exist in a process of change in the first resonance frequency of the golf club head. The region $R_1$ can be considered to be in a state in which the rigidity of the golf club head gradually drops due to fatigue breakage. The region $R_2$ can be considered to be in a state in which a crack develops in the rear surface of the impact surface and the like, and that the crack propagates toward the front surface. The region $R_3$ can be considered to be in a state in which the crack reaches the impact surface, and the crack rapidly propagates. From this, it can be considered that the crack begins to develop in the rear surface of the impact surface and the like in a region A, which is a boundary region between the region $R_1$ and the region $R_2$. That is, it can be considered that the region A is a region at which breakage of the golf club head begins. Further, the crack reaches the impact surface in a region B where the crack is verified visually.

For the case of the example shown in FIG. 2, the inventors of the present invention discovered that defects due to a crack or damage in the golf club head develop when the value of the first resonance frequency is less than 95% of the initial value (the value of the first resonance frequency in an initial state). Cracks and damage cannot be identified visually mainly in the region $R_2$ in which the ratio of the first resonance frequency to the initial value is less than 95%. However, it can be predicted that a crack or damage in an inside portion of the impact surface 10 has developed. It is evident that breakage of the golf club head 1 after about 200 times of impacts are imparted thereto from this state can be verified visually. Thus, it is clear that, when the value of the first resonance frequency is less than 95% with respect to the initial value, there is developed at least a crack or damage that can not be identified visually in some part of the golf club head 1, which leads to breakage. Therefore, the initial value is taken as a reference value, and evaluation for verifying the development of breakage, such as a crack, damage, or the like, which can not be visually verified, can be performed by using the ratio of the first resonance frequency to this reference value. Note that, although the critical condition of the evaluation for verifying the development of breakage by using the ratio of the first resonance frequency to the reference value is set such that the ratio is 95%, the present invention is not limited to this value. The condition may also be set such that the ratio is less than 80%, less than 90%, less than 97%, or less than 99%. For example, the condition may also be changed according to brand, product model, or type, such as golf club number, driver, spoon, and the like.

Further, the peak frequency used by the present invention is not limited to the first resonance frequency of the impact surface, and high order resonance frequencies, such as the second, third, and the like, may also be used.

Although breakage is recognized conventionally through visual observation upon development of a crack, damage, or the like in the front surface of the impact surface, the development of a crack, damage, or the like, which can not be distinguished visually, can be ascertained before the breakage is recognized visually in prior art.

A time series data can be obtained by measuring the first resonance frequency with this type of measurement for each single impact, or every plurality of impacts, for example, every 10 impacts. Periods in which breakage of the golf club head develops can be quantitatively grasped by the number of impacts.

In particular, the above-mentioned limit design is being performed with hollow golf club heads. The rear surface of the impact point of the impact surface easily becomes the starting point for breakage in this type of hollow golf club head. A crack propagates from this starting point toward the front surface of the impact surface, leading to breakage of the entire golf club head. The state of the rear surface of the impact surface of the golf club head of the golf club during use cannot be easily observed without breaking the golf club head. Therefore, with a conventional visual evaluation method, breakage has to be verified at a state in which the breakage has progressed to a certain extent.

Further, the hollow golf club head is joined to a head main body portion by welding the impact surface. Therefore, breakage does not necessarily develop in the rear surface of the impact point of the impact surface due to welding irregularities and the like, and a crack or damage may also often develop from a joining portion joined through welding.

Thus, attention must be paid not only to the impact surface of the golf club head but also to the joining portion surrounding the impact surface, as the starting point for the development of cracks.

In the method for evaluating quality of the present invention, the rate of change of the first resonance frequency with respect to the initial value is found, for example. Moreover, for the vibration mode of the impact surface in the first resonance frequency, the impact surface has the maximum displacement at a center region of the impact surface, and has maximum strain at a peripheral region of the welding portion and the like. Therefore, the generation of a crack or damage at a position where, conventionally, it is impossible to visually verify the crack or damage, or a crack or damage having a size that cannot be visually verified, easily effects in the first resonance frequency. A period during which there are large changes in the first resonance frequency accompanied by the number of times of impacts is specified and can be set as a period during which a crack or damage develops. The generation of a crack or damage in the golf club head can thus be identified, and therefore the times series characteristics of the first resonance frequency, which is measured in advance, with respect to the number of times of impacts can be stored according to brand, according to product model, or according to type, such as golf club number or type. By referring to this, period during which there is the complete breakage of the golf club head can be quantitatively predicted. The durability of the golf club head can therefore be quantitatively evaluated.

In this embodiment, a vibration is imparted to the impact surface 10 of the golf club head 1 by using the hammer 2, after imparting impacts by golf balls, or imparting impacts equivalent thereto, and the first resonance frequency is found.

However, the present invention is not limited to this. Golf ball impacts may be imparted to the impact surface by a human or a robot, or the impacts may be imparted by striking the impact surface with a golf ball using an air cannon, and the first resonance frequency may also be measured from an impact sound emitted when imparting these impacts.

In addition, the first resonance frequency before and after one round of golf play by a golfer on a golf course is measured, and the presence or absence of the development of a crack or damage to the current golf club head can be judged and evaluated from the measurement results. Further, the first resonance frequency of the golf club head in an initial state, for example, can be displayed in advance on a label 12 (refer to FIG. 1) such as a seal, a tag, or the like, that is affixed to the golf club head or the golf club. Once a predetermined period of time has elapsed after the golfer has purchased this golf club and begun using it, the golf club can be brought into a golf club shop or the like where the first resonance frequency can be measured to judge whether or not a crack or damage has developed in the current golf club head.

Figure 3:
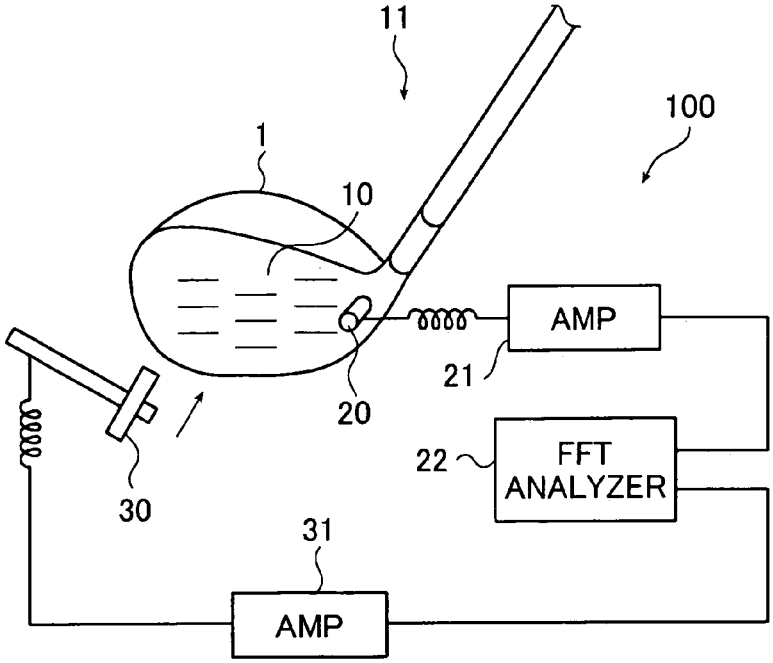
FIG. 3 is a schematic diagram showing a measuring device utilized in another method for measuring a first resonance frequency.

Further, although the first resonance frequency is measured based on an impact sound in this embodiment, it is not limited to this, and may also be measured by another method. For example, the golf club head may be hit by an impact hammer, an acceleration signal of the impact surface at this time may be measured as a response signal, and the first resonance frequency may be found from this acceleration signal. FIG. 3 is a schematic diagram showing a measuring device that utilizes another method for measuring the first resonance frequency.

As shown in FIG. 3, an acceleration pickup 20 is affixed to the impact surface 10 of the golf club head 1, and the measuring device 100 imparts a vibration to the impact surface 10 using an impact hammer 30. An acceleration signal obtained by the acceleration pickup 20 through an amp 21, and an input signal of a impact force which is obtained using the impact hammer 30 which can measure an input force through an amp 31, are input to a FFT analyzer 22, and a function of the acceleration signal to the input force, that is a transfer function, is found by the FFT analyzer 22. Impact vibration is performed by scattering impact points on the impact surface 10 of the golf club head 1 at which vibration is imparted by the impact hammer, and the transfer function is found for each impact point. In a plurality of transfer functions found in this manner, there exist sharp peaks possessing identical phases, which are caused due to the form of the first resonance frequency vibration mode of the impact surface 10, regardless of the impact points. The frequency at this peak position is extracted as the first resonance frequency. The first resonance frequency may also be measured in this manner.

Further, the impact surface may also be vibrated by using a vibrator as a substitute for the impact hammer, thus imparting vibration. In this case, using an acceleration signal ratio, which is a response signal of the impact surface to a vibration input force imparted by the vibrator, that is, a transfer function at the vibration point, resonance frequencies of the impact surface, such as the first, the second, and the like, may also be found. A peak frequency in a predetermined frequency range, found from the frequency dependency of the response signal of the impact surface to the acceleration signal of the vibrator, may also be used. That is, the frequency dependency may be found by using the method disclosed by JP 05-33071 B, and the peak frequency in a predetermined frequency range may also be used. This case differs from a case in which the peak frequency of the transfer function is the resonance frequency of the impact surface. The peak frequency does not represent the resonance frequency of the impact surface, but at least the peak frequency changes in accordance with changes in the resonance frequency of the impact surface, and therefore the durability of the golf club head can be evaluated using these changes. In this case the peak frequency may be set to a frequency range of 600 Hz to 3000 Hz. Note that the peak frequency is not limited to the first resonance frequency of the impact surface in the present invention, and that high order resonance frequencies, such as the second, the third, and the like, may also be used.

An evaluation of the durability of the golf club head can thus be performed by using the resonance frequency of the impact surface. The presence or absence of the development of breakage to the golf club head, such as a fine crack, damage, or the like that is not breakage that can be visually verified, can be known. The durability of the golf club head can therefore be evaluated before the point at which breakage of the golf club head can be verified visually, and in addition, the lifetime of the golf club head can be quantitatively predicted.

In addition, the quality of the golf club head can be controlled by the present invention as shown below by utilizing the resonance frequency of the impact surface of the golf club head.

Figure 4:
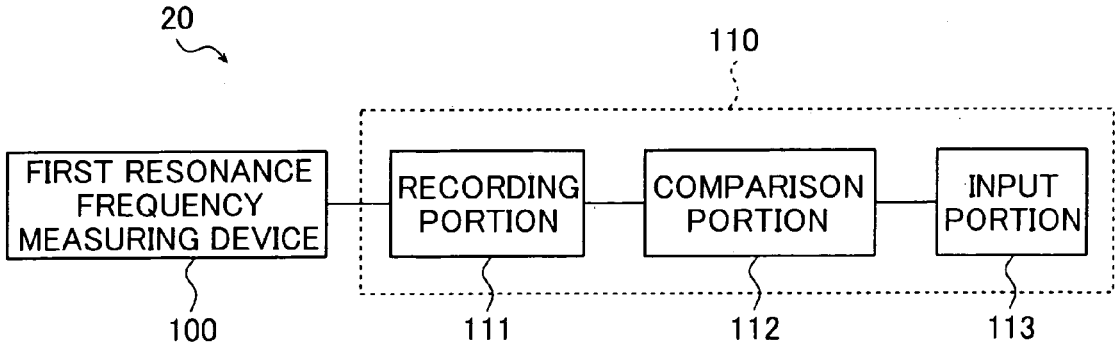
FIG. 4 is a schematic diagram showing a golf club control system used in a method for conducting quality control of a golf club head according to an embodiment of the present invention.

FIG. 4 is a schematic diagram showing a golf club control system used in a method for conducting quality control of a golf club head according to an embodiment of the present invention.

As shown in FIG. 4, a quality control system 20 has the device 100 for measuring the resonance frequency of the impact surface of a golf club, which is shown in FIG. 1, and a quality control portion 110. The quality control portion 110 has: a recording portion 111 in which the first resonance frequency of the golf club head, measured by the measuring device 100, is recorded; an input portion 113 into which the serial number (identification information) and the first resonance frequency of the golf club head are input; and a comparison portion 112 for comparing data input in the recording portion 111 of the input portion 113 with a permissible range of the first resonance frequency set based on a reference value discussed later, or the first resonance frequency of the golf club head in an initial state (initial value).

The reference value mentioned above is stored in the comparison portion 112 along with the serial number for each golf club head, for example. The reference value is a first resonance frequency, suitably set by items for controlling the quality such as the coefficient of restitution, durability, or the like. The reference value is, for example, a logical value extracted in advance from design specifications of the golf club head, or an experimental value of a test performed by using an accurately made prototype golf club head. A permissible range for the first resonance frequency is suitably set with respect to the reference value in consideration of manufacturing errors and the like. In a quality control process relating to the coefficient of restitution to be discussed later, whether or not a measured first resonance frequency is positioned within the permissible range is determined in the comparison portion 112, and those having frequencies positioned within the permissible range are taken as acceptable products, and those having frequencies positioned outside of the permissible range are taken as unacceptable products. Further, in a process for investigating the durability of the golf club discussed later, the first resonance frequency of the golf club head in an initial state (initial value) and the first resonance frequency of the golf club head after a lapse of a predetermined period of time are compared in the comparison portion 112, and a determination is made as to whether or not the durability is sufficient.

The first resonance frequency of the impact surface 10 is measured by this type of measuring device 100 for initial state golf club heads and golf club heads after a lapse of a predetermined period of time.

For cases in which the first resonance frequency of the golf club head in an initial state is measured, whether or not the coefficient of restitution of the golf club head is in a predetermined permissible range can be determined as an initial characteristic by this measurement because of a reason discussed later. Golf club heads having a coefficient of restitution in a predetermined permissible range, and which could not be selected conventionally, can thus be selected. It goes without saying that those outside of the permissible range are removed as unacceptable products.

Note that in the present invention, the reference value is not limited to one based on the coefficient of restitution. A reference value of the first resonance frequency based on a structural defect, such as a golf club head shape defect, excessive mass, insufficient mass, welding defect, or the like may also be used. Golf club heads that does not have the first resonance frequency within a permissible range are removed as not satisfying the standard.

For those golf club heads that satisfy the above stated initial characteristics, the first resonance frequencies thereof, corresponding to the serial numbers of the golf club heads, are recorded in the comparison portion 112. Further, the first resonance frequency of the golf club head in the initial state is displayed by the label 12, such as a seal, a tag, or the like affixed to the golf club head or the golf club (refer to FIG. 1), by imprinting, or the like. Golf clubs with the qualities of the initial characteristics of which are controlled, are thus supplied to the marketplace.

Note that the acceptable golf club heads with the qualities of initial characteristics of which are controlled, may be supplied to the marketplace after being assembled with a predetermined golf club shaft. Golf club heads may also be assembled into golf clubs, after which quality control of the initial characteristics is performed by measuring the first resonance frequency of the golf club heads, and then those selected as acceptable products may be supplied to the marketplace.

On the other hand, golf clubs supplied to the marketplace are purchased by golfers. After a predetermined period of time has elapsed since a golfer put to use the golf club, the golf club is brought in to a golf club retail store or the like equipped with the measuring device 100, and the first resonance frequency of the golf club head is measured. Then, the current durability of the golf club head is evaluated. In this way, the durability of the golf club head incorporating deterioration over time, such as whether or not a crack or damage has developed in the golf club head, remaining lifetime of the golf club, and the like is investigated.

In particular, limit design is being performed for hollow golf club heads, as discussed above, and therefore quality control based on deterioration over time is extremely effective in quality control of the durability of hollow golf club heads. It is therefore preferable that the golf club head periodically have its first resonance frequency measured. The durability incorporating deterioration over time as one item of quality can thus be investigated using the first resonance frequency discussed above.

Although the first resonance frequency is measured from the impact sound in this embodiment, there are no limitations placed thereon, and the first resonance frequency may also be measured by another method. For example, the golf club head may be hit by an impact hammer as shown in FIG. 3, and the acceleration signal of vibration of the impact surface obtained at that time may be measured as a response signal, and the first resonance frequency may be found from this acceleration signal, similar to the method for evaluating quality control of a golf club head. Note that the peak frequency in the present invention is not limited to the first resonance frequency of the impact surface, and high order resonance frequencies, such as the second, the third, and the like, may also be used.

Figure 5:
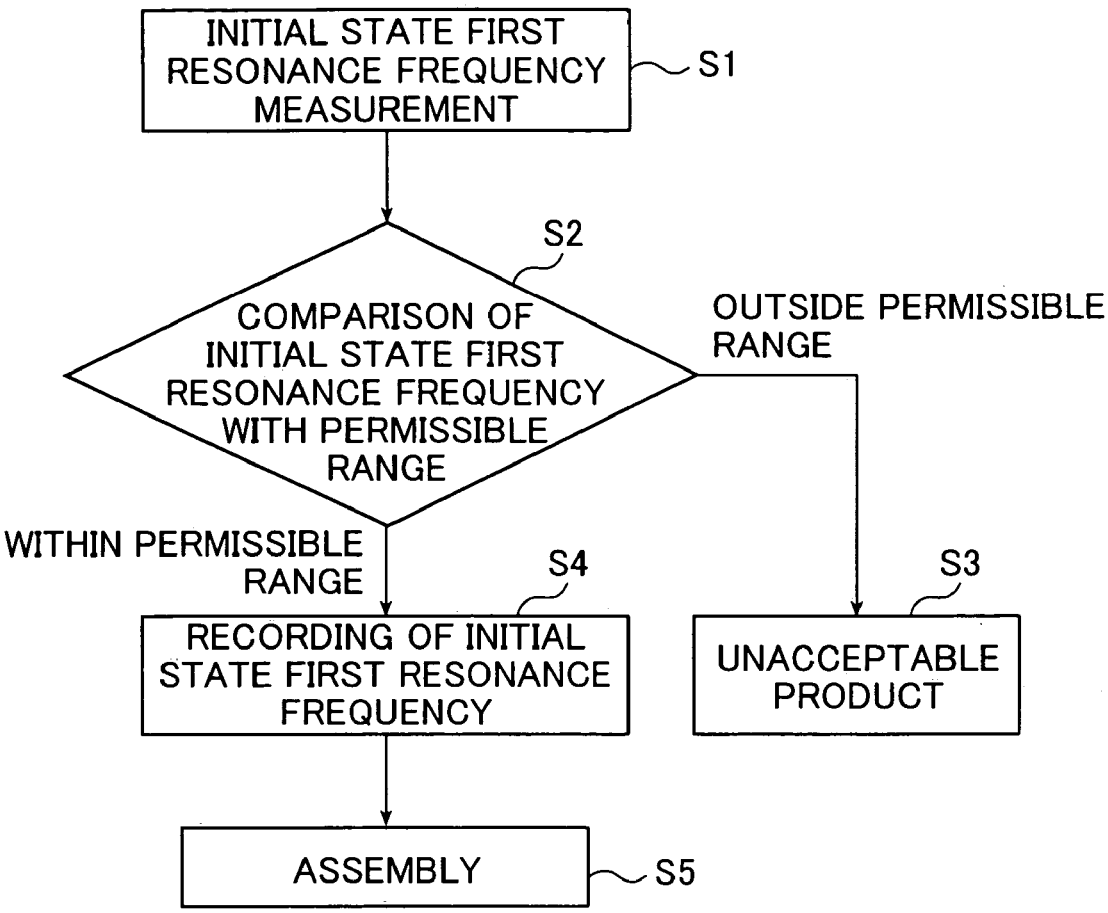
FIG. 5 is a flowchart of a method for conducting quality control of a golf club head according to an embodiment of the present invention.

A method for conducting quality control of a golf club head according to an embodiment of the present invention is explained next in detail. FIG. 5 is a flow chart showing a method for conducting quality control of a golf club head according to an embodiment of the present invention. According to the method for conducting quality control of a golf club head of this embodiment shown in FIG. 5, golf clubs as unacceptable products, in which the first resonance frequencies of golf club heads are outside a permissible range, are screened out, and the method is performed after the golf club heads are manufactured.

As shown in FIG. 5, the first resonance frequencies of a plurality of golf clubs in an initial state and manufactured by the same design specifications are measured first by the method for measuring the first resonance frequency discussed above (step S1). The measurement results, corresponding to serial numbers, for example, are input into the recording portion 111 of the quality control portion 110 for each of the golf club heads. Note that the first resonance frequencies of the golf club heads in the initial state are the first resonance frequencies of the golf club heads to which the cumulative number of times of impacts by golf balls, or impacts equivalent to these impacts, is equal to or less than 10.

Next, the first resonance frequencies of the golf club heads in the initial state of each golf club head are compared with a permissible range (step S2).

Figure 6:
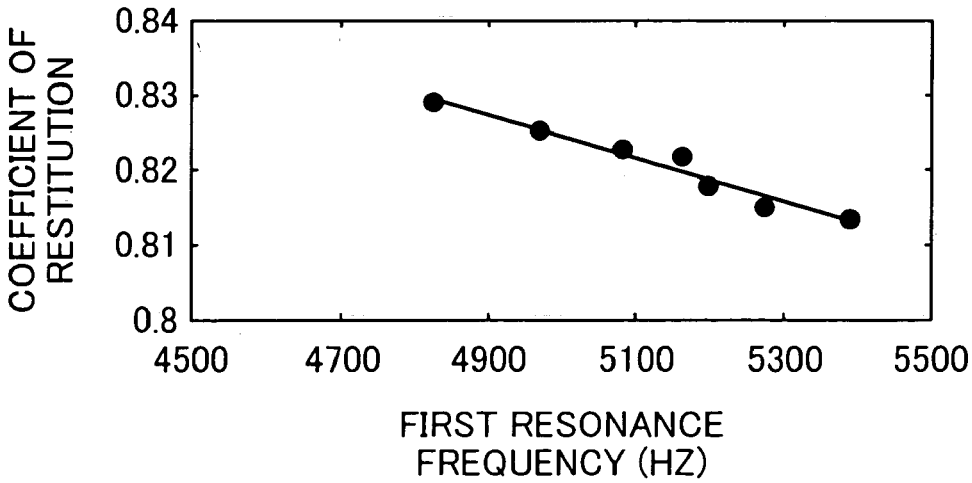
FIG. 6 is a graph showing the relationship between first resonance frequency and coefficient of restitution, with the first resonance frequency on the horizontal axis and the coefficient of restitution on the vertical axis.

FIG. 6 is a graph that shows the relationship between the first resonance frequency and the coefficient of restitution, with the first resonance frequency on the horizontal axis and the coefficient of restitution on the vertical axis. When the first resonance frequency and the coefficient of restitution are measured for the plurality of golf club heads having the same design specifications, there is variation in manufacture due to the material characteristics of structural members, dimensions, mass, and the like, of the golf club even though the golf club heads have the same design specifications, and therefore the coefficients of restitution differ. There is a correlation between the first resonance frequency and the coefficient of restitution measured by the above discussed method. In this case, if the first resonance frequency is taken as f, a coefficient of restitution e has a linear shape relationship with the first resonance frequency possessing a correlation factor $R^2$ of 0.9589, for example, shown in the linear regression equation given below.

$$e=-3\times10^{-5}f+0.9697$$

The coefficient of restitution e can therefore be controlled by the first resonance frequency, provided that the above stated linear regression equation is provided for each type of golf club head designed.

Figure 7:
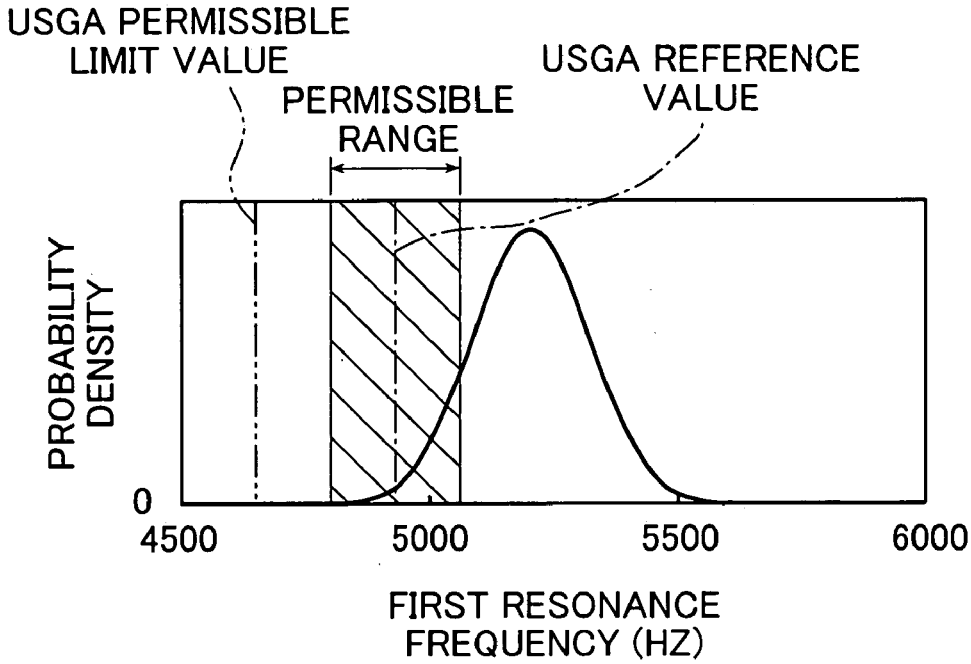
FIG. 7 is a graph showing the distribution of the first resonance frequency, with the first resonance frequency on the horizontal axis and the probability density on the vertical axis.

FIG. 7 is a graph showing the distribution of the first resonance frequency, with the first resonance frequency on the horizontal axis and the probability density on the vertical axis. The distribution of the first resonance frequency shown in FIG. 7 is obtained by measuring 200 golf club heads manufactured by identical design specifications. Note that a double dot-dash line segment shown in FIG. 7 shows USGA permissible values of the coefficient of restitution (coefficient of restitution e of 0.830), and a single dot-dash line shows the USGA reference value (coefficient of restitution of 0.822).

For example, in order to satisfy a rule for the coefficient of restitution e determined by the USGA (coefficient of restitution e is equal to or less than 0.830), the first resonance frequency is set to 4656 Hz in this case from the above stated equation as a USGA permissible limit value (4656 Hz is set as the USGA permissible limit value in FIG. 6). Among the golf club heads measured, 99% or more are less than the USGA permissible limit value (their first resonance frequency is equal to or greater than 4656 Hz), and unacceptable products are equal to or less than 1%.

Further, it is understood from the above equation that it is sufficient to set a permissible range of the first resonance frequency to a range from 4790 Hz to 5057 Hz, and to set the average value of the first resonance frequency to 4923.5 Hz ((4790 Hz*5057 Hz)/2) in order to obtain golf clubs having a coefficient of restitution e of 0.822 (USGA reference value) ±0.004.

For cases in which the first resonance frequency of the golf club head in the initial state is outside of the permissible range in the step S2, the golf club head is taken as an unacceptable product (step S3). A golf club shaft is not assembled into the golf club head taken as an unacceptable product.

On the other hand, for cases in which the first resonance frequency of the golf club head is within the permissible range, the golf club head is taken as an acceptable product, and the first resonance frequency of the golf head in the initial state is recorded on the golf club head as identification information along with a serial number, for example, by imprinting (step S4). In this case, the serial number and the corresponding first resonance frequency may also be recorded on paper, or a recording medium such as a flexible disk, for example. Further, the first resonance frequency is recorded and stored in the comparison portion 112 along with identification information such as the serial number. Note that there are no particular limitations on the method for recording the first resonance frequency on the golf club head, provided that the first resonance frequency is specified.

A golf club shaft is then assembled into the golf club head on which the value of the first resonance frequency is recorded (step S5). In this way, a golf club is manufactured by assembling a golf club head which has undergone quality control.

Note that the above stated flow of the steps S1 to S5 is not limited to their being performed independently by a golf club assembler. They may also be performed by: a golf club head manufacturer, who manufactures golf club heads which have undergone quality control, by measuring the first resonance frequency of the golf club head, comparing it with the permissible range, and selecting acceptable products after forming the golf club head by performing welding, and the like, on-structural members of the golf club head; and a golf club assembler, who assembles a golf club shaft into the golf club head, and provides a golf club whose quality has been controlled. Specifically, the golf club head manufacturer may provide, in addition to the golf club heads to be delivered, a recording medium such as paper, a flexible disk, or the like, on which the first resonance frequency is recorded for each of the golf club heads along with identification information of the golf club heads, for the golf club assembler to whom delivery is made. The golf club assembler who has received the delivery can utilize the first resonance frequency stored in the recording medium in the processes of the step S4 and the step S5.

In the method for conducting quality control of a golf club head of this embodiment, the coefficient of restitution that could not be identified conventionally, can thus be controlled by measuring the first resonance frequency of the initial state in each golf club head, and determining whether or not the measured value of the first resonance frequency is positioned within a permissible range.

Figure 8:
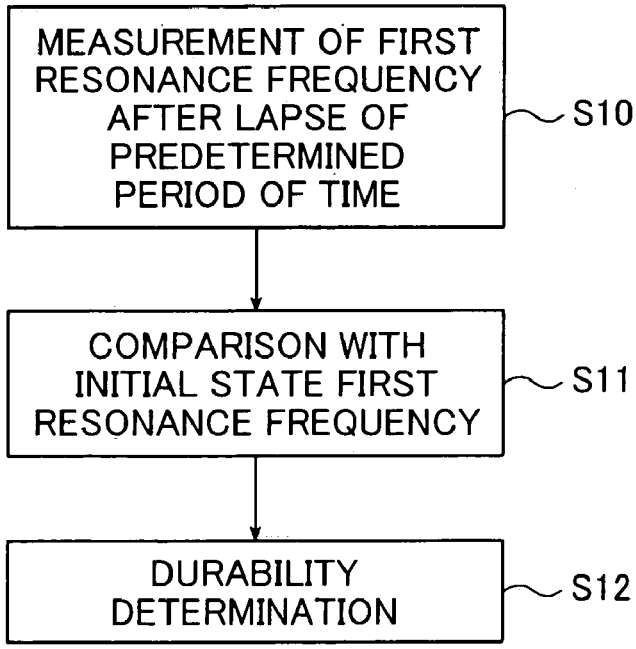
FIG. 8 is a flowchart showing a method for conducting quality control of a golf club head after a lapse of a predetermined period of time, according to an embodiment of the present invention.
Figure 9:
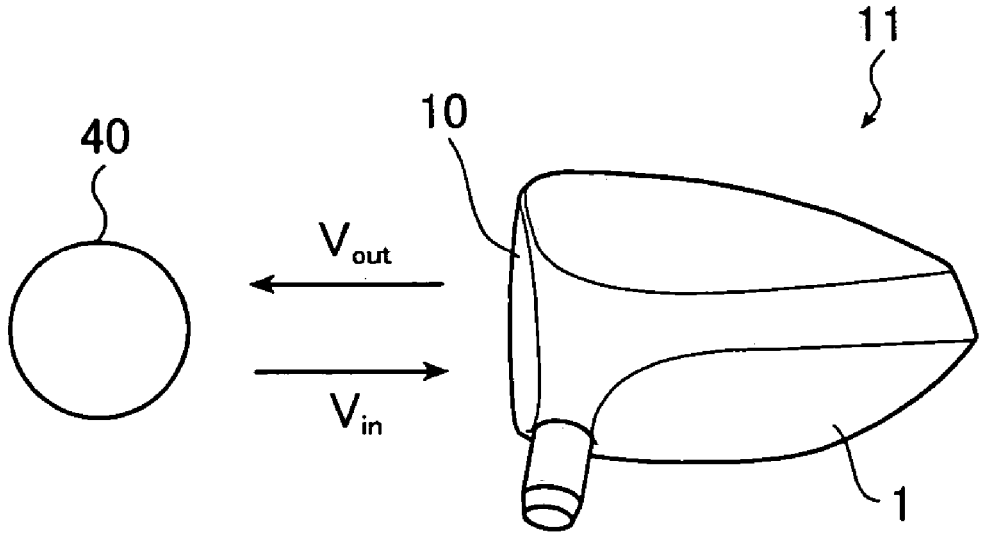
FIG. 9 PRIOR ART
FIG. 9 is a schematic diagram showing a method for measuring the coefficient of restitution of a golf club head.

Next, a description will be made on a method for conducting quality control of a golf club head of a golf club, which is judged to be the above discussed acceptable product, after a lapse of a predetermined period of time. FIG. 8 is a flowchart showing a method for conducting quality control of a golf club head, after a lapse of a predetermined period of time, according to an embodiment of the first embodiment of the present invention.

First, the first resonance frequency of the golf club head of the golf club is measured after a lapse of a predetermined period of time by using the measuring device 100 shown in FIG. 1 (step S10). The measured first resonance frequency is then recorded in the recording portion 111. Identification information for the golf club head that has been measured, for example, a serial number, is then input to the input portion 113. The first resonance frequency at the time when the golf club head was in the initial state (initial value), which is stored corresponding to the serial number, is thus called out and compared. There are no particular limitations placed on this input to the input portion 113, and input may be performed by using an input device such as a keyboard, for example.

Further, the value of the first resonance frequency of the golf club head in the initial state may be converted into a barcode and recorded on the label 12 of the golf club head. This barcode may be read by a known reading device and input to the input portion 113 to be used in a comparison with the measured first resonance frequency. It is preferable that the first resonance frequency be measured periodically and the durability be checked intermittently in this embodiment in order to control the durability based on deterioration of the golf club head over time.

The first resonance frequency, which is recorded in the recording portion 111, and the first resonance frequency of the golf club head in the initial state (initial value) are then compared in the comparison portion 112 (step S11).

Next, from the comparison results, a threshold value for the first resonance frequency with respect to the first resonance frequency in the initial state is set to 95%, for example, and the golf club head is judged to have come to an end of its lifetime for cases in which the threshold value is less than this value (less than 95%). The durability of the golf club is thus judged based on this threshold value (step S12).

Note that, the reason that the durability can be evaluated and judged by using a ratio of the first resonance frequency with respect to the first resonance frequency in the initial state is because a characteristic curve like that shown in FIG. 2 is obtained for the relationship between the first resonance frequency and the cumulative number of times of impacts imparted by golf balls, or by impacts corresponding to those impacts, imparted to the golf club, and the durability can be evaluated based on this, as described above.

The durability can therefore be judged, and the quality control of durability can therefore be conducted, by comparing the ratio of the first resonance frequency of the golf club head after a lapse of a predetermined period of time to first resonance frequency in the initial state, with the threshold value. The golf club head is thus judged to have come to an end of its lifetime when the first resonance frequency of the golf club head is less than the threshold value.

The degree of drop from the strength of the golf club head in the initial state is found in this embodiment by inputting the first resonance frequency in the initial state and the first resonance frequency after a lapse of a predetermined period of time, and the durability is determined from the degree of drop. In this case the durability may be determined by taking into consideration the above stated characteristic curve obtained from the cumulative number of times of impacts. Note that the threshold value is set in advance corresponding to the type and form of the golf club, and it is not always necessary to set the threshold value to 95% as described above.

Note that, by storing in the comparison portion 112 characteristic curves of the first resonance frequency for each type and also each form of the golf club head in accordance with the cumulative number of times of impacts as shown in FIG. 2, in a reference table, a follow-up investigation into the quality of durability can be conducted concerning deterioration over time for golf club heads that are periodically brought in for testing. The quality of the durability of the current golf club head can be labeled from the reference table, and the number of impacts until the lifetime of the golf club head is reached can be predicted.

Whether or not the golf club durability is sufficiently ensured can be judged in this embodiment based on the threshold value by measuring the first resonance frequency of the golf club actually used after shipping.

For example, for cases in which a customer's complaint that the golf club characteristics have changed is received, whether or not the change in characteristics is due to the durability of the golf club head can be judged by measuring the first resonance frequency of the golf club head that is subject to the complaint.

Regarding the coefficient of restitution, which is one of the initial characteristics of the golf club head, the quality of the coefficient of restitution as an initial characteristic is determined in this embodiment by measuring the first resonance frequency. For those golf club heads in which the initial characteristic is determined to be satisfactory, quality control is further conducted for deterioration over time by the first resonance frequency. The quality of the golf club head can thus be controlled consistently, and golf club heads, and golf clubs having predetermined characteristics can be provided.

Note that, although the method for conducting quality control of a golf club head is explained in this embodiment, the present invention is not limited thereto.

The method for conducting quality control of this embodiment may also be incorporated into a method for manufacturing a golf club head, for example. In this case, the golf club heads as acceptable products, the qualities of which are assured by measuring the first resonance frequency of the manufactured golf club heads manufactured by joining members thereof by welding, or the like, can be manufactured and shipped. Note that the method for conducting quality control of this embodiment may also be applied to a process for manufacturing the golf club head and a golf club head assembly preprocess. In this case, double inspections are performed by the supplier side and by the customer, thereby increasing the quality assurance precision. Golf club heads which are controlled or manufactured by any of the above described methods for quality control, and methods for manufacturing have sufficient performance. Further, the method for conducting quality control of this embodiment can also be applied to a method for manufacturing a golf club. In this case, an effect similar to that of this embodiment can be obtained. In addition, golf clubs manufactured by this method for manufacturing a golf club have golf club heads in which a predetermined quality is assured, and it goes without saying that predetermined characteristics are satisfied. In addition, quality may also be controlled by measuring the first resonance frequency again after assembly for golf clubs manufactured as stated above thus, quality control of higher precision can be preformed.

In accordance with the present invention, the peak frequency is measured, and by comparing this peak frequency with the permissible range, quality not capable of being checked by visual inspection, such as the durability, the coefficient of restitution, or the like of golf club heads and golf clubs can be evaluated. The durability and the coefficient of restitution of the golf club heads can therefore also be controlled, whereby higher quality can be maintained.

What is claimed is:

1. A method for manufacturing a golf club head, comprising the steps of:

a first step of setting a permissible range of a first resonance frequency for a value of a coefficient of restitution based on a linear regression equation which determines a relationship between the first resonance frequency of a vibration of an impact surface of each of a plurality of golf club head samples found from a response signal obtained by imparting a vibration to the impact surface thereof and a coefficient of restitution of each of the plurality of golf club head samples determined by an incident velocity and a rebound velocity of a golf ball upon impact to the impact surface, a mass of the golf ball and a mass of a golf club head sample, a second step of forming a golf club head;

a third step of measuring a first resonance frequency of a vibration of an impact surface of the formed golf club head from a response signal obtained by imparting a vibration to the impact surface; and a fourth step of selecting the golf club head as an acceptable product or a unacceptable product by comparing the permissible range of the first resonance frequency set in the first step with the first resonance frequency measured in the third step, whereby the golf club head with the coefficient of restitution thereof controlled by using the first resonance frequency of the golf club head is manufactured.

2. The method for manufacturing a golf club head according to claim 1, further comprising a step of recording the first resonance frequency, making it correspond to information for distinguishing the golf club head selected as an acceptable product after the fourth step.

3. A method for manufacturing a golf club, comprising the steps of:

a first step of setting a permissible range of a first resonance frequency for a value of a coefficient of restitution based on a linear regression equation which determines a relationship between the first resonance frequency of a vibration of an impact surface of each of a plurality of golf club head samples found from a response signal obtained by imparting a vibration to the impact surface thereof and a coefficient of restitution of each of the plurality of golf club head samples determined by an incident velocity and a rebound velocity of a golf ball upon impact to the impact surface, a mass of the golf ball and a mass of a golf club head sample, a second step of assembling a golf club shaft into a golf club head having a cumulative number of impacts of ten times or less;

a third step of measuring a first resonance frequency of a vibration of an impact surface of the golf club head, to which the golf club shaft is assembled, from a response signal obtained by imparting a vibration to the impact surface; and a fourth step of selecting the golf club head as an acceptable product or a unacceptable product by comparing the permissible range of the first resonance frequency set in the first step with the first resonance frequency measured in the third step.

4. The method for manufacturing a golf club according to claim 3, further comprising a step of recording and storing the first resonance frequency of the golf club head selected as an acceptable product, making the first resonance frequency correspond to information for distinguishing the golf club head after the fourth step, wherein the first resonance frequency specified by the distinguishing information is set as an initial value to be used for investigating durability of the golf club head.

5. The method for manufacturing a golf club according to claim 3, wherein the durability of the golf club head is judged based on a change of a first resonance frequency thereof from the initial value.

6. The method for manufacturing a golf club according to claim 4, wherein the golf club head having a first resonance frequency of less than 95% with respect to the initial value is judged as an end of lifetime.

* * * * *